US006841110B2

(12) United States Patent
Seppänen et al.

(10) Patent No.: US 6,841,110 B2
(45) Date of Patent: Jan. 11, 2005

(54) METHOD AND PLANT FOR MANUFACTURING PRESTRESSED CONCRETE PRODUCTS

(75) Inventors: Aimo Seppänen, Sääksmäki (FI); Heikki Kankkunen, Vantaa (FI)

(73) Assignee: Addtek Research Development OY AB, Vantaa (FI)

( * ) Notice: Subject to any disclaimer, the term of this patent is extended or adjusted under 35 U.S.C. 154(b) by 246 days.

(21) Appl. No.: 10/204,354

(22) PCT Filed: Mar. 2, 2001

(86) PCT No.: PCT/FI01/00208

§ 371 (c)(1),
(2), (4) Date: Aug. 29, 2002

(87) PCT Pub. No.: WO01/64409

PCT Pub. Date: Sep. 7, 2001

(65) Prior Publication Data

US 2003/0057597 A1 Mar. 27, 2003

(30) Foreign Application Priority Data

Mar. 3, 2000 (FI) ..... 20000489

(51) Int. Cl.[7] ..... B28B 21/90; B28B 21/08; B28B 21/60; B28B 23/08

(52) U.S. Cl. ..... 264/229; 264/70; 264/209.1; 264/211.11; 425/64; 425/111; 425/114; 249/126

(58) Field of Search ..... 264/35, 70, 209.1, 264/211.11, 228, 229, 33; 425/64, 114, 111; 249/126

(56) References Cited

U.S. PATENT DOCUMENTS

| | | | | | |
|---|---|---|---|---|---|
| 2,234,663 | A | * | 3/1941 | Anderegg | 264/228 |
| 3,510,107 | A | | 5/1970 | Fidler | |
| 3,523,343 | A | * | 8/1970 | Mitchell | 425/88 |
| 3,947,171 | A | * | 3/1976 | Yasuda et al. | 425/88 |
| 3,999,913 | A | * | 12/1976 | Branitzky | 425/111 |
| 4,141,946 | A | * | 2/1979 | Rauenhorst | 264/69 |
| 4,273,740 | A | * | 6/1981 | Marchesi et al. | 264/228 |
| 4,337,020 | A | * | 6/1982 | Ito et al. | 425/129.1 |
| 4,421,710 | A | * | 12/1983 | Borcoman | 264/228 |
| 5,184,924 | A | * | 2/1993 | Takalo et al. | 408/67 |
| 5,976,442 | A | * | 11/1999 | Manning | 264/228 |

FOREIGN PATENT DOCUMENTS

| | | | | | |
|---|---|---|---|---|---|
| DE | 2931506 | A | * | 2/1980 | B28B/13/00 |
| DE | 29 31 506 | A1 | | 2/1980 | |
| FI | 61653 | B | | 5/1982 | |
| FI | 73383 | B | | 6/1987 | |
| FI | 80846 | B | | 4/1990 | |
| FR | 2573697 | A1 | * | 5/1986 | B28B/15/00 |
| FR | 2 573 697 | A | | 5/1986 | |
| GB | 2231527 | A | * | 11/1990 | B28B/7/36 |
| GB | 2 311 747 | A | | 10/1997 | |
| GB | 2311747 | A | * | 10/1997 | B28B/15/00 |
| WO | WO 85/04362 | A1 | | 10/1985 | |

* cited by examiner

*Primary Examiner*—Michael P. Colaianni
*Assistant Examiner*—Michael I. Poe
(74) *Attorney, Agent, or Firm*—Burns, Doane, Swecker & Mathis, LLP

(57) ABSTRACT

A method for the production of prestressed concrete products and a plant for implementing the method. Moulds provided with pretensioned wires are moved through fixed casting machines into a hardening space. In the hardening space, the combination of mould and product is lifted sideways from the casting line before hardening, using synchronised lifting equipment. The combination may be stacked for space economy. After hardening, the product is removed from the mould using the same lifting equipment. The moulds are returned to the beginning of the casting line, during which stage they are cleaned and refurbished. The products are transferred to cutting and finishing stations.

16 Claims, 4 Drawing Sheets

METHOD AND PLANT FOR MANUFACTURING PRESTRESSED CONCRETE PRODUCTS

FIELD OF THE INVENTION

The invention relates to the field of the production of concrete products. Particularly, the invention relates to a method for the production of long, prestressed concrete products using mobile moulds.

TECHNOLOGICAL BACKGROUND

Prestressed concrete products are traditionally prepared on long, mobile prestressing beds. Thereby, all production machines move along the casting beds, whereby their work area is very large. The concrete must be transferred to mobile casting machines in various parts of the production area, whereafter the fresh concrete is fed to moulds while the machines move across the mould. After hardening, the prestressing wires are cut, and the necessary cutting and boring operations are carried out in situ. The products are transferred to a store, and after cleaning, the prestressing wires can be fitted on the casting beds for the next casting.

A so-called carousel production system is known for short products, in which instead of fixed casting beds and mobile machines, mobile moulds and fixed casting and other work-stations are used. Said system is more flexible than the system with fixed casting beds, but when long prestressed products, or several elongated prestressed products are to be produced in series on the same casting bed, the hardening stage will slow down the production, because the filled moulds are to be left alone for a long time before the hardened product can be removed. From patent application GB 9607158.4 a plant for the production of prestressed concrete products is known, in which the concrete products are cast on beds provided with tensioning wires, while said beds move under the stationary casting machine. After the whole length of the product is cast, the whole product is pushed sideways in a heated hardening space. After hardening, the whole product passes through a sawing station in the direction opposite to the casting direction. The products, cut to their final length, are lifted from the bed and brought out of the circulation, after which the casting bed is transferred to a furnishing station by pushing sideways, cleaned and furnished for the next casting.

Said publication GB 9607157.4 discloses five parallel stations for the hardening stage, which arrangement is in harmony with the unloading and equipment stations of the other side of the circulation, but which considerably limits the amount of castings being at the same time in the hardening stage.

DESCRIPTION OF THE INVENTION

The present invention relates to a method for the production of prestressed concrete products. The method is based on a fixing casting station and mobile, long casting beds. All production machines remain at their work stations, and correspondingly the moulds and the products are moved. In addition, the invention relates to a plant for implementing the method of the invention.

The casting can be carried out by using an extruding technique or a slip casting technique, as has been disclosed e.g. in the FI patent 85350, or by using another slip casting technology, as described in the FI patent 101208. The casting speed of the casting machine is adapted according to the motion of the mould. The products can be, for example, ordinary prestressed hollow-core concrete slabs, or pretensioned beams. The prestressing is carried out against the mould, whereby no separate floor-based anchors are needed.

After the casting, the casting bed together with the product cast thereon, is transferred sideways from the casting line to a heat treatment using lifting equipment. The transfer of the casting beds sideways by lifting is advantageous in respect of space utilization, because in that case the moulds together with their cast products, can be stacked in a heat treatment space, and several stacks can be formed adjacent to each other. The lifting to the heat treatment space, and after hardening to a further processing line, can easily be automated. After hardening, the combination of mould and product is lifted to the beginning of a reinforcement line, where the product is lifted as a long uniform body sideways to a finishing processing line, where it moves forward along a roller track in order to be cut into pieces of a predetermined length. As the product is lifted off, the mould becomes free, and is thereafter transported along the roller track in order to be furnished with reinforcements, and further to a intermediate store to wait for the next casting. During said transfer the mould is cleaned and provided with prestressing wires. Thus, no separate operational steps are needed for said procedure.

DETAILED DESCRIPTION

Figure 1:
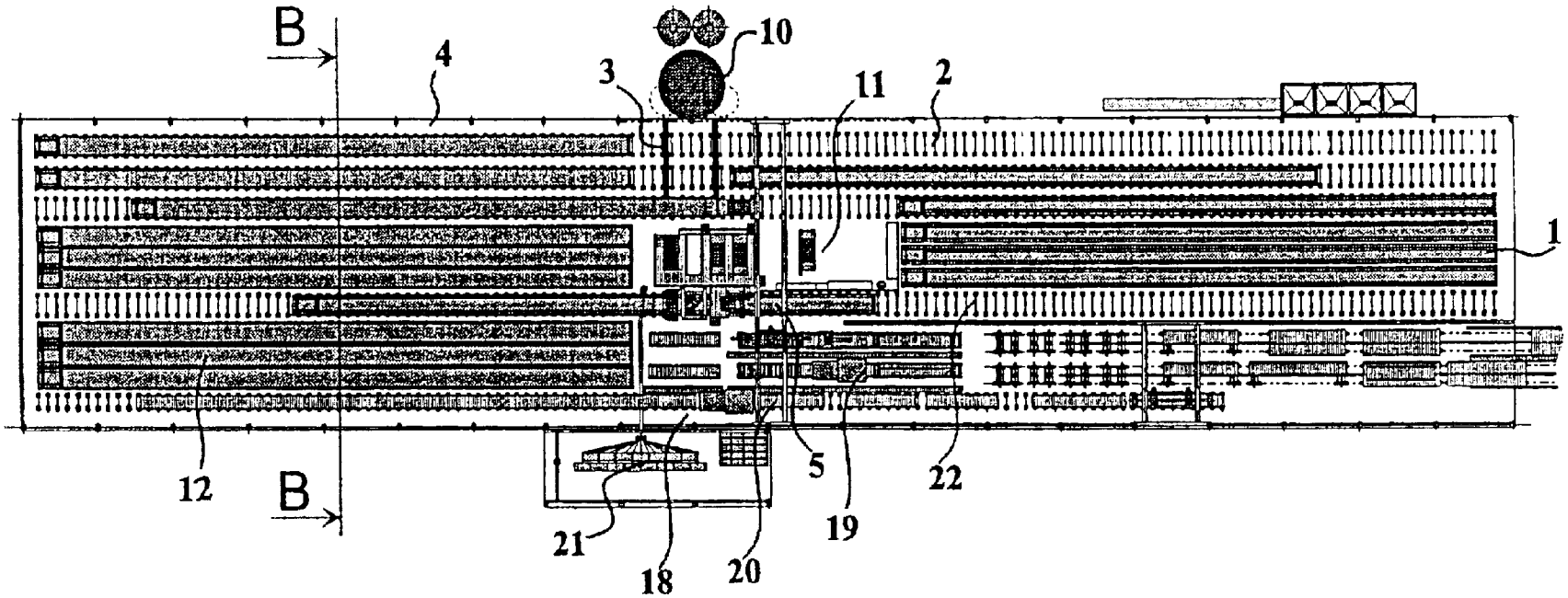
FIG. 1 shows a schematic plane view of a production plant in which a method according of the invention is applied.

FIG. 1 shows a production plant for applying a method according to the invention. In FIG. 1, a station 1 of the prepared moulds or casting beds is shown on the center right. The casting is carried out while the mould moves to the left along a roller track 2 through a casting station 3, to a heat treatment space 4.

All moulds to be used in the process are separate units of the desired length, which are circulated along with the production from the furnishing station of the mould to a casting station, from the casting station to heat treatment and from there further to an unloading station. Preferably, the casting length is more than 30 m. The moulds are designed to withstand the prestressing. Before the reinforcement, the mould is brushed and oiled mechanically. The prestressing wires are fitted to a mould in connection with the transfer of the mould at a station 5, near to which a wire store 21 is arranged. It is advantageous to assemble the wires during the transfer of the mould from a fixed feeding station, in contrast to the method of the above described prior art.

Figure 2:
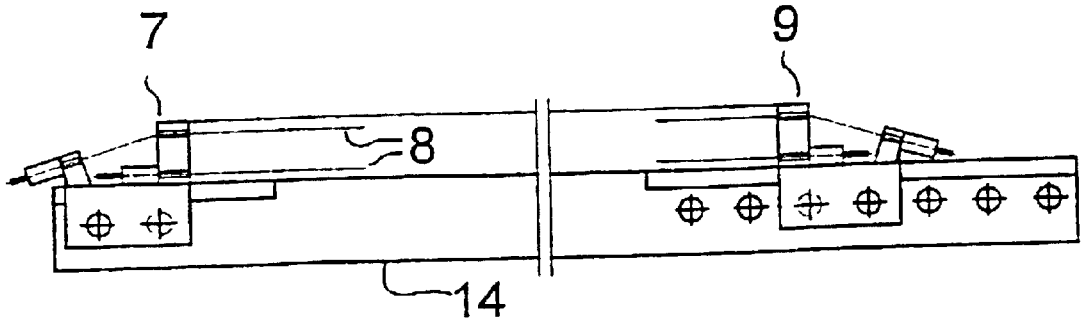
FIG. 2 shows the providing of moulds with wire.

The FIG. 2 shows an arrangement of the wires. The prestressing wire is slipped through locking plates 7, 9 and provided with required locking wedges. As the cleaned mould moves along the roller track 22 (FIG. 1) to the wire spreading point, the locking plate 7 of the passive end and the prestressing wire 8 fitted thereto are locked first. At the wire spreading point is also arranged a bundle prestressing device, which is let down from above the mould to the active end of the mould. The mould is moved forward on the roller track, whereby the wires 8, which run through the locking plate 9 of the active end, are combed directly into proper positions on the casting bed during the transfer. After the transfer in longitudinal direction, the active end of the locking plate 9 is attached to the mould, and the locking wedges are fitted to the wire clamps. The bundle is tightened to effect the prestressing.

The mobile locking plates are thus constructed, that in addition to being wire fastening points, they also act directly as starting and finishing stopper plates during the casting.

The casting can be started directly from the starting stopper plate, and be finished directly at the finishing stopper plate. In this way, it is possible to entirely avoid starting and finishing reject, as well as, due to the movability of the locking plates, to minimize the amount of wasted wire.

The sidewise transfer from the reinforcement position 5 to the beginning of the casting line is carried out by means of sidewise transfer lifting equipment which is provided in the ceiling of the hall. The moulds already reinforced can be intermediately stored at the furnishing station of the hall before they are transferred to the beginning of the casting line.

On the casting line, the mould is moved by means of friction drives in longitudinal direction on the roller track 2 (FIG. 1). The concrete station 10 is placed partly on the side of the hall and partly above the casting station 3, whereby the concrete can be led directly to a casting machine. Therefore, no separate transfer conveyors are needed. The concrete station can be unattended, as can the casting station, whereby the operation of the various units is controlled from a common, suitably located control room.

The casting station comprises fixed casting machines operating in parallel, of which preferably 1 to 3 or even more are provided, depending on the capacity of the production plant. The functions related to the maintenance of the casting machines can be placed adjacently to the casting station, for example at station 11. At the casting station, several casting machines can operate simultaneously, whereby transfer roller tracks for the mould must be provided in the same number as casting machines. FIG. 1 shows three casting tracks. The casting machine is fixed during casting, and the casting bed or mould moves below the casting machine according to the progress of the casting stage. The casting machines can be provided as conventional slipforming machines, as described, for example, in the FI patents 85350 and 101208. Preferably, starting and ending stopper plates according to FI patent applications 991690 and 991691 are applied to the moulds, whereby the casting stage can be started and finished with hardly any reject.

Immediately after casting, as the concrete is still fresh, required openings are provided, for example according to markings made by a marking machine, or a machine for making openings is automatically controlled on the basis of slab data. The concrete removed from the openings can be returned into the concrete station mixer or directly into the casting machine. After hardening, the prestressing wires in the openings can be removed at the finishing processing station.

As the bed is completely cast and the possible openings are provided, the bed is moved to heat treatment space 4 (FIG. 1). Preferably, the heat treatment space is an isolated, closed space, separated from other spaces with a separation wall. Therefore, the temperature and moisture of the heat treatment space can be defined case by case, depending on the speed of the production cycle. The moulds can move along the roller tracks to the heat treatment space and from there through openings provided in the separation wall.

Figure 3:
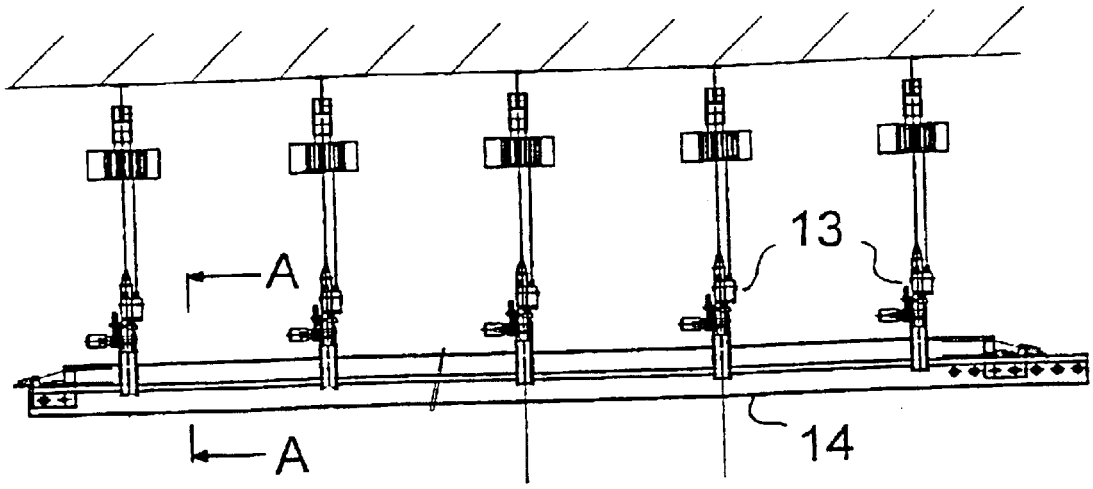
FIG. 3 shows a side view of a lifting arrangement to be used for transferring the loaded moulds sideways.

In the heat treatment space, the mould is moved by means of the transversal transfer lifting equipment to a pre-programmed hardening station 12. FIG. 3 shows the lifting equipment. The lifting is carried out synchronously, the lifting means 13 being arranged essentially equally spaced along the length of the mould 14, and the lifting precision of the lifting equipment being sufficient in relation to the strength of the mould. Preferably, lifting points are provided at intervals of 5 to 15 metres; more preferably, the lifting points are provided at intervals of about 9 metres; during the lifting, the precision of the lifting points in the vertical direction is preferably about +/−25 mm; more preferably, the precision is +/−5 mm. Thus, the difference between the said points in the vertical direction is no more than 50 mm, preferably no more than 10 mm.

The sufficient lifting precision can be obtained by using height measurement, for example a pulse sensor, in each of the lifting devices. In addition, frequency inverters are used in order to control the frequency of lifting and traversing motors, as well as by arranging one of the lifting devices as master and the others as so-called slave hoists. The precision of the sideway transfer can be achieved in the same manner.

Figure 4:
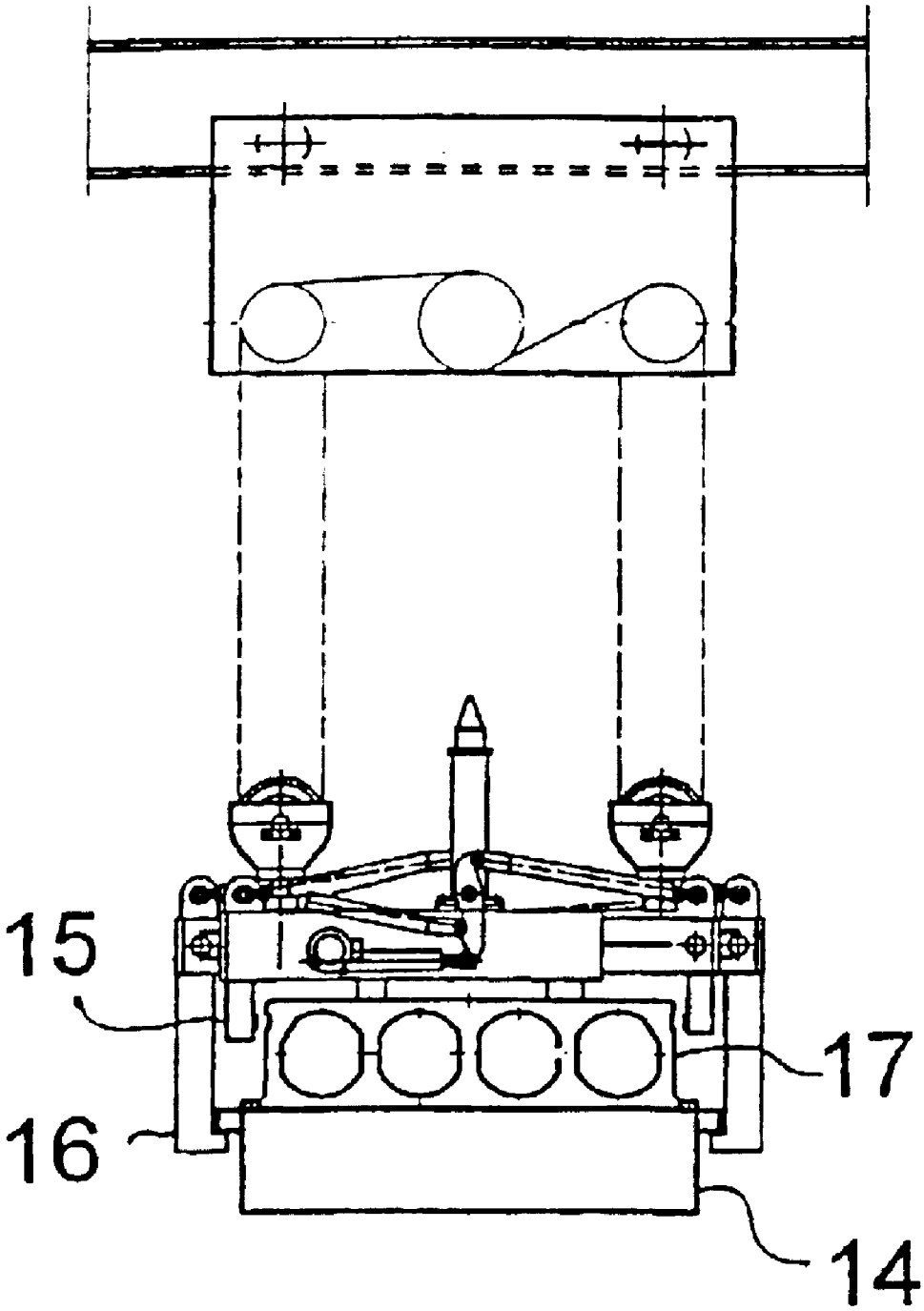
FIG. 4 shows a section along the line A—A of the lifting equipment according to FIG. 3.

FIG. 4 shows a section of the equipment according to FIG. 3 along the line A—A. The lifting equipment is provided both with lifting tongs 16 for lifting the moulds, and with lifting tongs 15 for transferring the hardened product 17. The side profiles enabling stacking of the moulds are not shown in the section view. After hardening, the mould 14 together with the product lying thereon is transferred by lifting as a unit to the beginning of the reinforcement line, after which the product lying on the mould is lifted as a whole to an unloading line. The mould slides in longitudinal direction through the cleaning station back to the reinforcement station 5 (FIG. 1). The product slides in longitudinal direction on the finishing processing line 18 out from the heat treatment space directly to a cutting station 20, to be cut and finished.

At the cutting station, the plates are cut into their proper length, provided with water holes and, if required, the openings and the cuttings formed in the unhardened product are finished by using water cutting methods or mechanical machine tools. The device for making water holes, preferably automatic, can also operate using high-pressure water jet methods or boring.

The transversal and diagonal cutting is carried out by using an automatic saw with a folding blade, arranged at the beginning of the cutting station. The plates to be longitudinally split can be moved to the track 19 adjacent to the cutting station 20, on which track the split saw equipment is arranged.

The waste material resulting from the finishing treatment can be arranged to fall directly on transfer conveyors which automatically transfers it to a recycling point.

Figure 5:
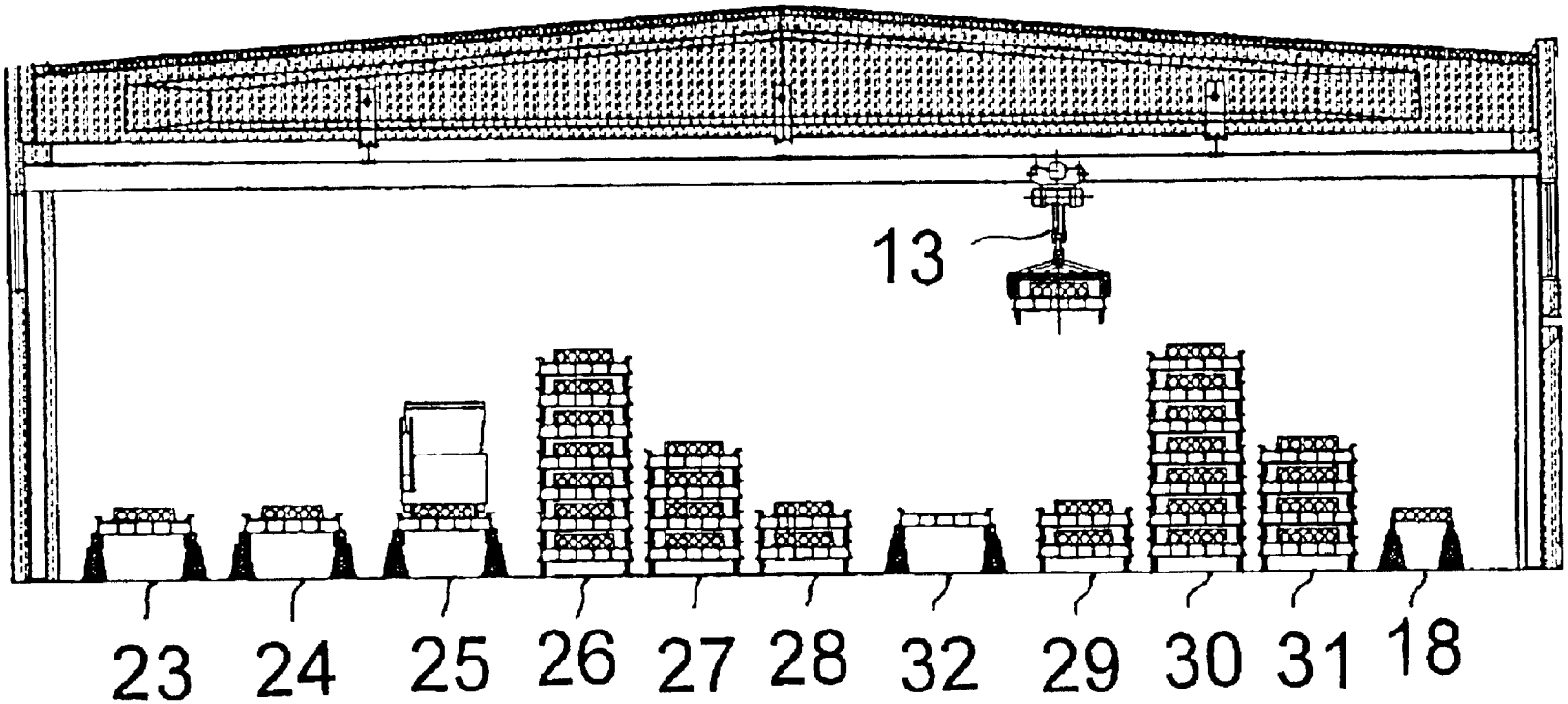
FIG. 5 shows a section along the line B—B of the production plant according to FIG. 1.

FIG. 5 shows the arrangements of the heat treatment or hardening space. The castings arrive on three casting lines 23, 24, 25, from which they are stacked together with their beds at the hardening stations 26–31. The casting beds are so designed, that stacking is possible without disturbing the unhardened product. Changing of the stacking order within each stack is carried out during the hardening by means of the above described lifting equipment, preferably under computer control, by using stations 26 to 31. In this way, unloading of the products from the casting beds can be carried out following hardening in the same order as the casting. The products lifted as whole units from the casting beds are removed along track 18 through cutting station 20 as described above. Correspondingly, the casting beds are returned along track 32 through the furnishing station to storage.

Compared to the arrangement according to the prior art, a considerably large capacity is achieved, because by means of the lifting and stacking technique, a large number of products can be simultaneously held in the hardening stage.

What is claimed is:

1. A method for production of prestressed concrete products, comprising the steps of:

directing prestressing forces of prestressing wires functioning as reinforcements to a casting bed, onto which concrete is fed during casting from stationary machines while moving a mould, wherein the casting bed having a length of at least 30 m; and transferring the casting bed sideways from a casting line before hardening of the concrete, by lifting synchronously from several lifting points located at determined intervals, wherein during the lifting of the casting bed and product, a difference between the lifting points in a vertical direction is less than or approximately equal to 50 mm.

2. A method according to claim 1, wherein the casting beds and the products are lifted using same lifting equipment.

3. A method according to claim 1, wherein the product is removed as a unit from the casting bed by lifting.

4. A method according to claim 1, wherein the mould is provided with wires during transfer of the mould from a hardening space to a beginning of the casting line.

5. A method according to claim 1, wherein the products are slip cast slabs.

6. A method according to claim 5, wherein the products are slip cast hollow-core concrete slabs.

7. A method according to claim 1, wherein the casting beds are stacked together with their products for a time of hardening.

8. A method according to claim 7, wherein the products are slip cast slabs.

9. A method according to claim 7, wherein the casting beds and the products are lifted using same lifting equipment.

10. A method for production of prestressed concrete products, comprising the steps of:

directing prestressing forces of prestressing wires functioning as reinforcements to a casting bed, onto which concrete is fed during casting from stationary machines while moving a mould, wherein the casting bed having a length of at least 30 m; and transferring the casting bed sideways from a casting line before hardening of the concrete, by lifting synchronously from several lifting points located at determined intervals, wherein during the lifting of the casting bed and product, a difference between the lifting points in a vertical direction is less than or approximately equal to 10 mm.

11. A method according to claim 10, wherein the products are slip cast slabs.

12. A method according to claim 10, wherein the casting beds and the products are lifted using same lifting equipment.

13. A method according to claim 10, wherein the product is removed as a unit from the casting bed by lifting.

14. A method according to claim 10, wherein the mould is provided with wires during transfer of the mould from a hardening space to a beginning of the casting line.

15. A method according to claim 10, wherein the casting beds are stacked together with their products for a time of hardening.

16. A method according to claim 15, wherein the products are slip cast slabs.

* * * * *